US009681735B2

(12) United States Patent
Schreiber et al.

(10) Patent No.: US 9,681,735 B2
(45) Date of Patent: Jun. 20, 2017

(54) APPLICATOR FOR A COSMETIC PRODUCT, IN PARTICULAR MASCARA AND METHOD OF PRODUCING SUCH AN APPLICATOR

(71) Applicant: Albea Services, Gennevilliers (FR)

(72) Inventors: Camille Schreiber, Paris (FR); Anne Rutigliano, Maisons-Laffitte (FR); Patrick Lhoyer, Mouy (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 14/666,524

(22) Filed: Mar. 24, 2015

(65) Prior Publication Data

US 2015/0272299 A1 Oct. 1, 2015

(30) Foreign Application Priority Data

Mar. 25, 2014 (FR) ..... 14 52504

(51) Int. Cl.

| | |
|---|---|
| ***A46B 9/02*** | (2006.01) |
| ***A45D 40/26*** | (2006.01) |
| ***A46B 3/18*** | (2006.01) |
| ***A46D 3/05*** | (2006.01) |
| ***A46D 1/04*** | (2006.01) |

(52) U.S. Cl.

CPC ..... *A45D 40/265* (2013.01); *A46B 3/18* (2013.01); *A46B 9/021* (2013.01); *A46B 9/028* (2013.01); *A46D 1/04* (2013.01); *A46D 3/05* (2013.01); *A46B 2200/1053* (2013.01)

(58) Field of Classification Search

CPC ..... A46B 9/026; A46B 9/028
USPC ..... 15/206, 207; 132/218, 317
See application file for complete search history.

(56) References Cited

U.S. PATENT DOCUMENTS

| | | | | |
|---|---|---|---|---|
| 5,853,011 | A * | 12/1998 | Gueret | A45D 40/267 132/218 |
| 6,237,609 | B1 | 5/2001 | Vasas | |
| 8,651,117 | B2 * | 2/2014 | Gueret | A45D 40/267 132/200 |
| 2002/0020426 | A1 | 2/2002 | Gueret | |
| 2008/0184512 | A1 * | 8/2008 | Gueret | A45D 40/265 15/206 |
| 2010/0294299 | A1 * | 11/2010 | Gueret | A45D 34/042 132/218 |
| 2012/0082503 | A1 * | 4/2012 | Gueret | A45D 40/267 401/122 |

FOREIGN PATENT DOCUMENTS

FR 2811525 A1 1/2002

OTHER PUBLICATIONS

Dec. 11, 2014, French Search Report—App 1452504.

* cited by examiner

*Primary Examiner* — David Walczak
*Assistant Examiner* — Joshua Wiljanen
(74) *Attorney, Agent, or Firm* — Banner & Witcoff, Ltd.

(57) ABSTRACT

An applicator for a cosmetic product, in particular mascara, comprises a twisted core and fibers which extend from the core and are held by the core, the core having a main longitudinal direction of extension, known as the main axis (X), and the core being rectilinear along the main axis (X), the fibers forming an envelope (E) with their free ends, characterized in that the envelope (E) comprises, along the main axis (X), a substantially concave face (F1) and a substantially convex, opposite, face (F3).

12 Claims, 1 Drawing Sheet

APPLICATOR FOR A COSMETIC PRODUCT, IN PARTICULAR MASCARA AND METHOD OF PRODUCING SUCH AN APPLICATOR

CROSS REFERENCE TO RELATED APPLICATIONS

This application claims priority to French Application Serial No. 1452504, filed Mar. 25, 2014, which is hereby incorporated by reference in its entirety.

FIELD

The invention relates to an applicator for a cosmetic product, in particular mascara. The invention also relates to a method for producing such an applicator.

BACKGROUND

Mascara applicators may be injection-moulded from plastics material and in this case are generally known as "plastics brushes". They can also be obtained from fibrous elements held between the longitudinal portions of a twisted metal shaft; in this case they are usually called "fibre brushes". Applicators for mascara have a core, or central portion, and bristles extending radially around said core. The ends of said bristles usually form envelopes extending in a longitudinal direction of extension of said brush. The bristles of the twisted brushes are usually known as the "fibres".

In particular, twisted brushes which make it possible to promote curling of the lashes are known. Said brushes comprise a core which is curved according to the desired curl.

SUMMARY

The invention proposes the production of a twisted brush which makes it possible to achieve a cosmetic effect of this type whilst adding a complementary effect.

The invention therefore relates to an applicator for a cosmetic product, in particular mascara, comprising a twisted core and fibres which extend from the core and are held by said core, said core having a main longitudinal direction of extension, known as the main axis, and said core being rectilinear along said main axis, said fibres forming an envelope with their free ends.

According to the invention, said envelope comprises, along said main axis, a substantially concave face and a substantially convex, and opposite, face.

The applicator of the invention therefore proposes a particular arrangement of fibres which improves the curl of the eyelashes of the user of such an applicator, whilst making it possible to load them in an optimum manner.

Actually, the concave face of said applicator makes it possible to curl the eyelashes. A concave face of this type is usually obtained from fibres which have the same radial extension from a curved core. In this case, the concave face is obtained from fibres having different radial extensions from a core, said core being rectilinear in contrast with the curved cores from the prior art. The applicator of the invention therefore has the advantage of optimally loading the eyelashes of the user, as the concave face thereof has fibres of small radial extension which have great loading power.

The particular arrangement of the fibres of the applicator of the invention also makes it possible to comb the eyelashes, which are curled and loaded by the concave face; said applicator has a convex face which is also formed from fibres having different radial extensions from the rectilinear core. It is said convex face which provides the applicator of the invention with this combing ability.

In other words, the fibres defining said concave and convex faces of the envelope extend radially in an asymmetrical manner relative to the core.

Further, the use of a twisted brush allows a greater fibre density than with the bristles of plastics brushes.

According to different embodiments of the invention, which may be taken together or separately:

- said faces each have a plane of symmetry containing the main axis,
- said faces are each generated by a straight line, known as the straight line generatrix, which is orthogonal to the main axis and orthogonal to the plane of symmetry of said face,
- a section of said envelope which is produced transversely to the main axis, referred to as the cross section, is in the shape of a polygon along said main axis,
- the shape of said cross section is a quadrilateral, in particular a rectangle, or indeed a square,
- said envelope further comprises at least two faces which are substantially convex, opposite and substantially symmetrical relative to a plane containing said main axis,
- said envelope comprises four faces, three of which are convex,
- the core has a distal end and a proximal end, the proximal end being opposite the distal end along the main axis,
- said fibres are distributed along the core, over a substantial portion of its length from the distal end,
- said core consists of a twisted rod,
- said proximal end of the core is prolonged by a portion of the rod that has no fibres,
- said envelope has a chamfer in the region of at least one of its faces, at the distal end of said core,
- the applicator forms a brush.

The invention also relates to a method for producing an applicator for a cosmetic product, in particular mascara, said method comprising:

- a step of positioning a plurality of fibres between longitudinal portions of a shaft, then
- a first step of twisting said shaft to form a twisted shaft having fibres that extend radially around said shaft, the ends of said fibres forming a cylindrical envelope that extends in a longitudinal direction of extension around said shaft, then
- a step of cutting the fibres, so that said fibres form an envelope with their free ends, said envelope comprising, along said main axis, a substantially concave face and a substantially convex, opposite, face forming in particular an envelope as described above.

According to different embodiments of the invention, which may be taken together or separately:

- said rectilinear shaft is kept rectilinear,
- said method comprises a second step of twisting said shaft after said fibre cutting step,
- said cutting is digitally controlled.

The invention also relates to a container for a cosmetic product, in particular mascara, suitable for containing an applicator as described above.

The invention will be better understood, and other objects, details, features and advantages thereof will appear more clearly in the course of the following detailed explanatory description of at least one embodiment of the invention given as a purely illustrative and non-limiting example, with reference to the accompanying schematic drawings.

DETAILED DESCRIPTION

The invention relates to an applicator 10 for a cosmetic product, in particular mascara, comprising a twisted core 12 and fibres which extend from the core 12 and are held by said core 12.

The core 12 is in this case formed by a metal rod, or shaft, comprising two branches, or longitudinal portions, which may be connected to each other by a curved portion. Said metal rod is, for example, folded in two so as to form a "U", the branches of the U then being twisted together.

Figure 1:
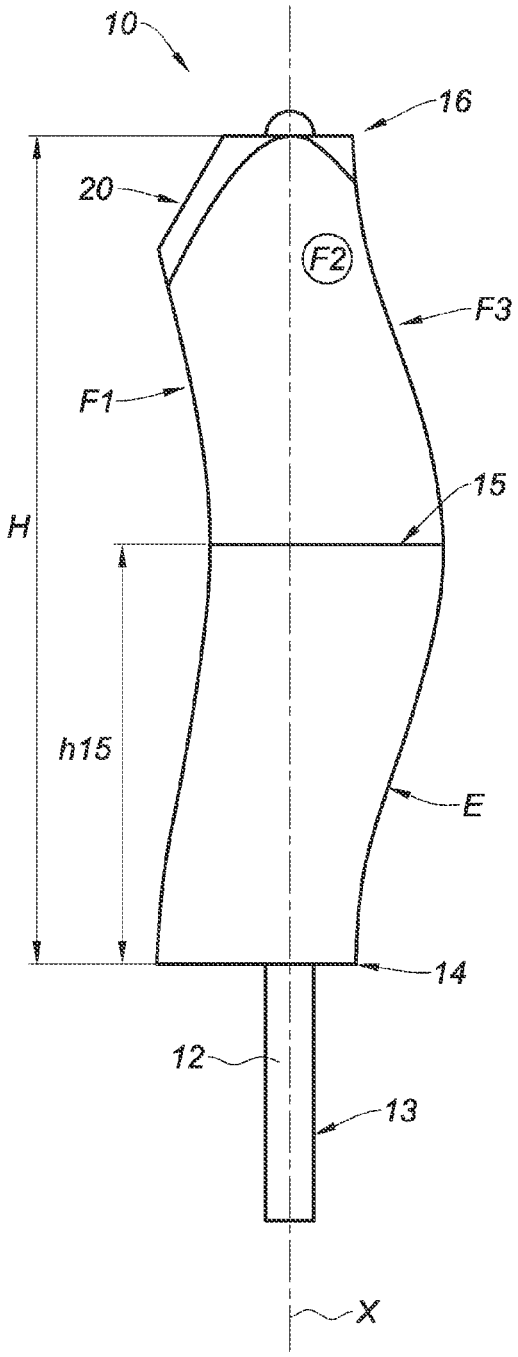
FIG. 1 is a front view of an embodiment of an applicator according to the invention.
Figure 2:
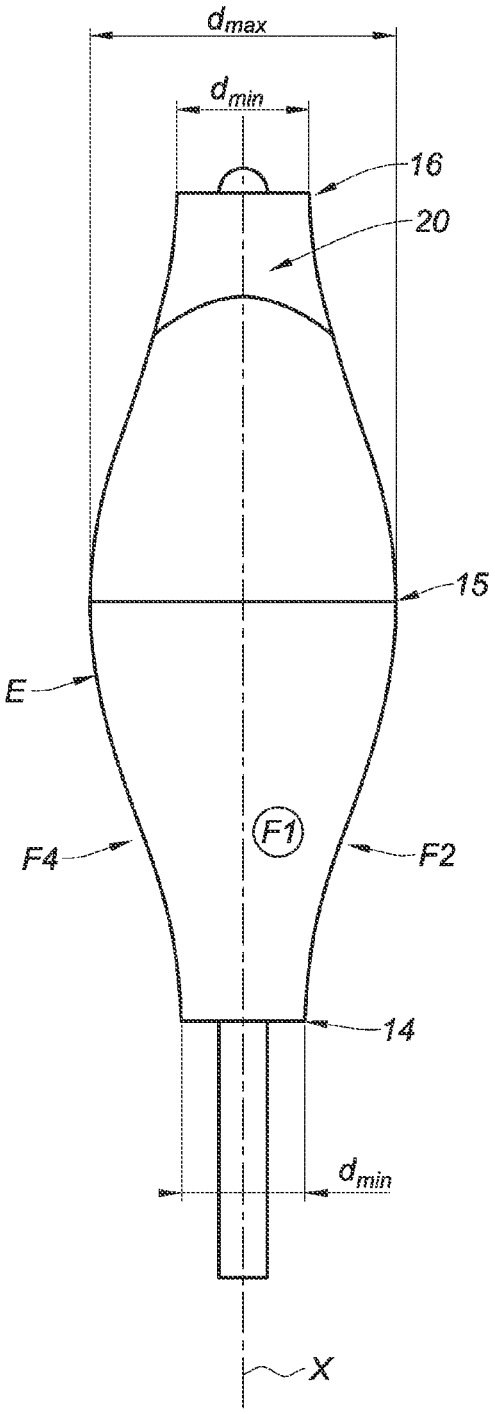
FIG. 2 shows the applicator from FIG. 1 after said applicator has been turned by a quarter turn about its longitudinal axis.

The fibres extend from the core 12, between a distal end 16 and a proximal end 14 of the core 12. The fibres each have a free end and form an envelope E therewith. FIGS. 1 and 2 illustrate in particular an embodiment of an envelope E according to the invention. The envelope impression will of course be more or less present depending on the density of the fibres.

The applicator 10 extends in a main longitudinal direction of extension, or main axis, which is marked X in FIGS. 1 and 2. This axis X is also the axis of the core 12. The core 12 is therefore straight.

The fibres thus extend transversely to the axis X, in particular radially, from the core 12 so as to form the envelope E with their free ends, between the distal 16 and proximal 14 ends of the core 12. These ends 14, 16 are opposite relative to the axis X and are separated, along said axis X, by a distance marked H in FIG. 1. Said distance H is, for example, between 22 mm and 30 mm, and substantially equal, for example, to 26 mm, or 27 mm. It should be noted that the proximal end 14 is in this case prolonged by a portion 13 of the rod 12 that has no fibres.

As illustrated in FIGS. 1 and 2, the envelope E has curved faces F1-F4 with variable slopes, or gradients, from said distal end 16 to said proximal end 14.

According to the invention, said envelope E comprises, along said main axis X, a substantially concave face F1 and a substantially convex, and opposite, face F3.

The concave face is marked F1 in FIG. 1. This concave face F1 has an extremum in the vicinity of an intermediate line 15 situated between the distal 16 and proximal 14 ends. Said intermediate line 15 forms part of a plane that is substantially orthogonal to the axis X which comprises an intermediate point of the axis X, said point being advantageously equidistant from said ends 14, 16. The distance h15 separating the proximal end 14 from this intermediate line 15, along said axis X, is substantially equal, for example, to 13 mm. This intermediate line 15 is an imaginary line that follows the periphery of the envelope E.

In FIG. 1, the convex face, opposite the concave face F1, is marked F3. This convex face F3 has an extremum for example in the vicinity of the intermediate line 15. Opposite face is understood to mean the face F3 which is located opposite the concave face F1 relative to the core 12. In other words, the opposite faces F1, F3 are not in contact.

FIG. 2 shows the applicator 10 when viewed from the side relative to FIG. 1. Here, the form of two faces F2, F4 can be seen, these being the faces that connect said two concave and convex faces F1, F3 which have just been described. Hereinafter, these faces F2, F4 will be referred to as connection faces.

In the embodiment shown here, these two connection faces F2, F4 are substantially convex. Said two connection faces F2, F4 have, in particular, an extremum in the vicinity of the intermediate line 15.

It should be noted that FIG. 1 shows the contours of the face F2, in a plane (that of the page); however, the curvature in space of said face F2 can be seen in FIG. 2 where it is shown in profile.

Similarly, the concave face F1, the contours of which are shown in FIG. 2, has a curvature in space that is particularly visible in FIG. 1.

The envelope E that has just been described comprises two pairs of faces F1, F3 and F2, F4. One of the pairs of faces comprises faces F2, F4 which are symmetrical relative to a mid-plane comprising the core 12; these are the faces known as the connection faces F2, F4. The other pair of faces F1, F3 follow substantially the same curve along the main axis X (see FIG. 1).

It should be noted that this embodiment is not limiting and the applicator 10 may have three, or four, or even six pairs of symmetrical faces without departing from the scope of the invention, as long as it has a pair of faces of which one is substantially concave F1 and the other is substantially convex F3.

It should be noted that said faces F1-F4 are advantageously generated by a straight line, known as the straight line generatrix, which is orthogonal to the core 12 and orthogonal to the plane of symmetry of each of said faces F1-F4. The envelope therefore has a cross section in a plane which is substantially orthogonal to said axis X, the shape of which is a polygon, along the entire length of said core 12, from said distal end 16 to said proximal end 14, said shape being in particular a quadrilateral, or indeed a rectangle, in particular in the region of the intermediate line 15.

The concave face F1 thus obtained, when the core 12 is advantageously rectilinear, makes it possible to obtain a better effect than that obtained with the twisted brushes that are usually used to curl eyelashes. When a user wishes to optimally curl their eyelashes, they are advised to favour mascaras which have the particular property of drying quickly in open air, in order to quickly set the curved shape of the eyelashes thus formed.

Twisted brushes having a curved core and fibres of the same radial extension along the entire length of said curved core, when they are used with a cosmetic product that dries quickly, have the disadvantage that they transfer said product to the lashes to only a limited extent, or even not at all. Therefore, said twisted brushes having a curved core cannot be used optimally.

By contrast, the applicator according to the invention—due to the concave face F1 thereof which is formed using fibres which do not have the same radial extension from the core 12, along the main axis X, which is substantially rectilinear itself—allows the use of said applicator with cosmetic products which have the particular property of drying quickly in open air. The cosmetic effect obtained with the applicator from the invention is thus optimised, that is to say that it makes it possible to curl the eyelashes whilst loading them with a cosmetic product which is particularly suitable for this application.

Further, the faces F1-F4 are advantageously delimited by disjointed lateral borders. In other words, the faces F1-F4 are delimited by edges—or lateral borders—which are parametric curves in a three-dimensional orthonormal Cartesian point of reference, one of said dimensions being merged with the direction of said axis X, the coordinates of said parametric curves changing in the three directions of said Cartesian point of reference and said parametric curves not merging at any point between said distal 16 and proximal 14 ends.

Said edges therefore have a complex outline while being obtained with faces that are nevertheless easy to produce. This outline is particularly advantageous for grasping and lengthening the eyelashes.

To make it easier to return the brush 10 to its container, the envelope of the applicator 10 may have chamfers 20 in the region of some of its faces, at the distal end 16 of the core 12. This is because the distal end 16 is usually the one that is in contact with the container when the user puts away the applicator 10 after use. Preferably, the envelope comprises at least one face with a chamfer 20, i.e. the substantially concave face F1. The height of this chamfer 20 will be less than or equal to 5 mm.

It is noteworthy that the width of the envelope E is functionally related to the advantages of the applicator 10; said width varies along the axis X, between the extremes, said extremes being marked dmax, dmin in FIGS. 1 and 2. dmax, dmin correspond, in addition, to the size of the envelope E, in particular to at least one of the dimensions of the cross section of the envelope E, said cross section being produced at different points of the main axis X.

Therefore, the following formula will advantageously be respected:

$$0.125 \leq d\min/d\max \leq 0.625.$$

For example, dmax will be between 6 and 8 mm and dmin will be between 3 and 4.5 mm.

The invention also relates to a method of producing an applicator for a cosmetic product, in particular mascara, for example the one that has just been described.

This method firstly comprises a step of positioning a plurality of fibres between longitudinal portions of a shaft (not shown). The fibres are distributed in such a way that said longitudinal portions pass substantially through the mid-point of each of said fibres.

The next step of said method is a first step of twisting said shaft to form a twisted shaft having fibres that extend radially around said shaft. The ends of said fibres therefore form a cylindrical envelope extending in a longitudinal direction of extension around said shaft. The fibres are distributed in the form of spirals of fibres owing to the twisting of the shaft.

The next step is a step of cutting the fibres, so that said fibres form an envelope E with their free ends, said envelope E comprising, along said main axis, a substantially concave face F1 and a substantially convex, opposite, face F3 forming in particular an envelope E as described above. Said cutting may be digitally controlled. Throughout these operations, the twisted rod is kept rectilinear.

Advantageously, the portion of the shaft with no fibres which prolongs the proximal end 14 is intended to be fixed inside a hollow rod, itself connected to a sleeve by which the user manipulates said applicator. Said portion may or may not be twisted.

It should be noted that the applicator 10 advantageously forms a brush.

It should also be noted that variants are of course possible. In particular, an embodiment that is not illustrated here can also be envisaged which has an envelope E that is helical in shape. In other words, the borders of the faces described above may follow a helix from the proximal end 14 to the distal end 16 of the applicator 10, for example by means of a second twisting step of the method according to the invention. The concave face is thus a warped surface.

We claim:

1. Applicator for a cosmetic product, in particular mascara, comprising a twisted core and fibres which extend from the core and are held by said core, said core having a main longitudinal direction of extension, known as the main axis (X), said core being rectilinear along said main axis (X), said fibres forming an envelope (E) with their free ends, characterised in that said envelope (E) comprises, along said main axis (X), a substantially concave face (F1) and a substantially convex, opposite, face (F3), wherein said envelope (E) further comprises at least two faces (F2, F4) which are substantially convex, opposite and substantially symmetrical relative to a plane containing said main axis (X).

2. Applicator according to claim 1, wherein said faces (F1, F3) each have a plane of symmetry containing the main axis (X).

3. Applicator according to claim 2, wherein said faces (F1, F3) are each generated by a straight line, known as the straight line generatrix, which is orthogonal to the main axis (X) and orthogonal to the plane of symmetry of said face (F1, F3).

4. Applicator according to claim 2, wherein a section of said envelope (E) which is produced transversely to the main axis (X), referred to as the cross section, is in the shape of a polygon along said main axis (X).

5. Applicator according to claim 2, wherein said envelope (E) has four faces (F1-F4) of which three are convex (F2-F4).

6. Applicator according to claim 1, wherein said faces (F1, F3) are each generated by a straight line, known as the straight line generatrix, which is orthogonal to the main axis (X) and orthogonal to the plane of symmetry of said face (F1, F3).

7. Applicator according to claim 6, wherein a section of said envelope (E) which is produced transversely to the main axis (X), referred to as the cross section, is in the shape of a polygon along said main axis (X).

8. Applicator according to claim 6, wherein said envelope (E) has four faces (F1-F4) of which three are convex (F2-F4).

9. Applicator according to claim 1, wherein a section of said envelope (E) which is produced transversely to the main axis (X), referred to as the cross section, is in the shape of a polygon along said main axis (X).

10. Applicator according to claim 9, wherein the shape of said cross section is a quadrilateral.

11. Applicator according to claim 1, wherein said envelope (E) has four faces (F1-F4) of which three are convex (F2-F4).

12. Container for a cosmetic product, in particular mascara, suitable for containing an applicator according to claim 1.

* * * * *